US011285584B2

(12) United States Patent
Hsieh

(10) Patent No.: US 11,285,584 B2
(45) Date of Patent: Mar. 29, 2022

(54) MAGNETICALLY ASSISTED DIRECTION-CHANGEABLE ROLLER WRENCH

(71) Applicant: KABO Tool Company, Taichung (TW)

(72) Inventor: Chih-Ching Hsieh, Taichung (TW)

(73) Assignee: KABO Tool Company, Taichung (TW)

( * ) Notice: Subject to any disclaimer, the term of this patent is extended or adjusted under 35 U.S.C. 154(b) by 0 days.

(21) Appl. No.: 17/301,806

(22) Filed: Apr. 15, 2021

(65) Prior Publication Data

US 2021/0347016 A1 Nov. 11, 2021

(30) Foreign Application Priority Data

May 7, 2020 (TW) ..... 109115245

(51) Int. Cl.
*B25B 13/00* (2006.01)
*B25B 13/46* (2006.01)
*B25B 23/00* (2006.01)

(52) U.S. Cl.
CPC ..... *B25B 13/462* (2013.01); *B25B 23/0007* (2013.01)

(58) Field of Classification Search
CPC ..... B25B 13/462; B25B 23/0007
USPC ..... 81/59.1, 60
See application file for complete search history.

(56) References Cited

U.S. PATENT DOCUMENTS 3,432,016 A * 3/1969 Vogt ..... G04B 11/006 192/45.005
5,970,825 A * 10/1999 Barnett ..... B25B 13/462 81/59.1
7,341,135 B2 * 3/2008 Jin ..... F16D 41/12 192/46
2019/0076995 A1 * 3/2019 Albertson ..... B25B 13/462

* cited by examiner

*Primary Examiner* — Joseph J Hail
*Assistant Examiner* — Shantese L McDonald
(74) *Attorney, Agent, or Firm* — Wang Law Firm, Inc.

(57) ABSTRACT

A magnetically assisted direction-changeable roller wrench has a main body, a driving member, a direction changing knob, plural rollers, a magnetic balancing member, and a magnetic positioning unit. The driving member, the rollers, and the direction changing knob are mounted in a head portion of the main body. The magnetic positioning unit includes a first and a second magnetic member located respectively on the driving member and the direction changing knob. The corresponding surfaces of the first and the second magnetic members have the same magnetic polarity, so a predetermined distance can be maintained between the first and the second magnetic members to secure the direction changing knob in position. The direction changing knob can displace each roller into contact with an engaging surface of the corresponding side of the driving member. The magnetic balancing member and the magnetic positioning unit lie in opposite directions to enable balanced magnetic attraction.

11 Claims, 15 Drawing Sheets

MAGNETICALLY ASSISTED DIRECTION-CHANGEABLE ROLLER WRENCH

BACKGROUND OF THE INVENTION

1. Technical Field

The present invention relates to a wrench and more particularly to a magnetically assisted direction-changeable roller wrench whose operation direction can be changed via a magnetic force and whose direction changing components can be secured in position magnetically.

2. Description of Related Art

FIG. 1 shows a conventional direction-changeable roller wrench 10. The head portion 11 of the roller wrench 10 has a circular receiving chamber 12 in which a driving member 14 is mounted. As shown in FIG. 2, the driving member 14 has six sides 15, and each side 15 has a central recess 152 and two lateral sides each formed with an engaging surface 151. Six rollers 16 are mounted respectively between the six sides 15 and a peripheral wall 13 of the receiving chamber 12. A direction changing knob 17 is mounted at the top end of the head portion 11. The bottom side of the direction changing knob 17 is protrudingly provided with six walls 171, and the gap between each two adjacent walls 171 forms a position-limiting groove 172, i.e., a total of six position-limiting grooves 172 are formed. The six rollers 16 are confined in the six position-limiting grooves 172 respectively, as shown in FIG. 2. The direction changing knob 17 is rotatable and can be secured at two positions by three magnetic positioning units 18, wherein each magnetic positioning unit 18 includes a pair of magnetic members. As shown in FIG. 1 and FIG. 3, the magnetic members of each of the three magnetic positioning units 18 are mounted respectively on the bottom side of the direction changing knob 17 and the top side of the driving member 14. The corresponding sides of the magnetic members of each magnetic positioning unit 18 are of the same magnetic polarity.

The direction changing knob 17 can be switched from a first position to a second position by being rotated in a predetermined direction. When the direction changing knob 17 is rotated to a position between the first position and the second position, referring to FIG. 3, the magnetic members of each magnetic positioning unit 18 are close to each other, and the same magnetic polarity of the corresponding, and now adjacent, sides of the magnetic members of each magnetic positioning unit 18 gives rise to a magnetic repulsive force that pushes the driving member 14 and the direction changing knob 17 away from each other. Once the magnetic members of each magnetic positioning unit 18 move past each other, the same magnetic repulsive force pushes the direction changing knob 17 toward the second position until the magnetic members of each magnetic positioning unit 18 are no longer close to each other, i.e., until the magnetic repulsive force between each pair of magnetic members no more exists. As a result, each roller 16 is in contact with the engaging surface 151 on one lateral side of the corresponding side 15 (e.g., the left engaging surface 151 of the corresponding side 15). Rotating the direction changing knob 17 in the opposite direction can switch the direction changing knob 17 from the second position to the first position and thereby move each roller 16 to the other lateral side of the corresponding side 15 and hence into contact with the engaging surface 151 on that lateral side of the corresponding side 15 (e.g., the right engaging surface 151 of the corresponding side 15). During the process, the magnetic members of each magnetic positioning unit 18 will also be brought close to each other, producing a magnetic repulsive force that pushes the direction changing knob 17 toward the first position. Thus, by switching the direction changing knob 17 to the first position or the second position, the operation direction of the roller wrench is changed.

While the direction changing operations of the conventional roller wrench 10 can be carried out with ease, the inventor of the present invention has found in his research that the three magnetic positioning units 18 of the conventional roller wrench 10 may have problem being effectively operated, the reason being that the magnetic repulsive force produced by the multiple magnetic positioning units 18 is so great that during the direction-changing rotating process, it cannot be easily overcome in order to switch the direction changing knob 17 to the intended position, and that the direction changing knob 17 may instead be moved back to its previous position by the magnetic repulsive force.

Moreover, the high cost of magnetic components adds to the material and production costs of the conventional roller wrench 10, which uses three magnetic positioning units 18.

BRIEF SUMMARY OF THE INVENTION

The present invention aims to solve the aforesaid problems of the prior art, the primary objective being to provide a magnetically assisted direction-changeable roller wrench whose operation direction can be easily changed and whose direction changing components can be secured in place with the same ease.

Another objective of the present invention is to provide a magnetically assisted direction-changeable roller wrench that uses fewer magnetic components, and therefore has a lower cost, than its prior art counterparts.

The present invention provides a roller wrench that includes a main body, a driving member, a direction changing knob, a plurality of rollers, at least one magnetic positioning unit, and at least one magnetic balancing member.

The main body has a head portion. A circular receiving chamber is provided in the head portion, and the center of the receiving chamber defines an axis.

The driving member has a plurality of sides, and each side has a central region and two engaging surfaces located respectively on two lateral sides of the central region. The driving member is mounted in the receiving chamber of the head portion and can be rotated in the receiving chamber about a rotation axis defined by the axis.

The direction changing knob is mounted in the head portion. The direction changing knob can be rotated between a first position and a second position.

The rollers are provided in the receiving chamber. The direction changing knob can drive the rollers into displacement.

The at least one magnetic positioning unit includes a first magnetic member and a second magnetic member. The first magnetic member is located on the driving member, and the second magnetic member is located on the direction changing knob. The corresponding sides of the first and the second magnetic members have the same magnetic polarity and can therefore produce a magnetic repulsive force for securing the direction changing knob at the first position or the second position.

The at least one magnetic balancing member is provided on the driving member or the direction changing knob. The magnetic balancing member and the magnetic positioning unit are located on two opposite sides of the axis respectively.

Preferably, the magnetic balancing member has a greater magnetic force than the first magnetic member or the second magnetic member.

The foregoing structures are so designed that fewer magnetic positioning units are used between the direction changing knob and the driving member than in the prior art to assist the changing of direction, and this reduces the magnetic repulsive force that must be overcome in a direction changing operation. Moreover, the magnetic balancing member helps balance the magnetic attractive force produced by the magnetic positioning unit, and the smaller number of magnetic components than in the prior art contributes to a lower production cost.

BRIEF DESCRIPTION OF THE SEVERAL VIEWS OF THE DRAWINGS

The objectives, features, and effects of the present invention can be better understood by referring to the following detailed description of some preferred embodiments in conjunction with the accompanying drawings, in which.

DETAILED DESCRIPTION OF THE INVENTION

Figure 1:
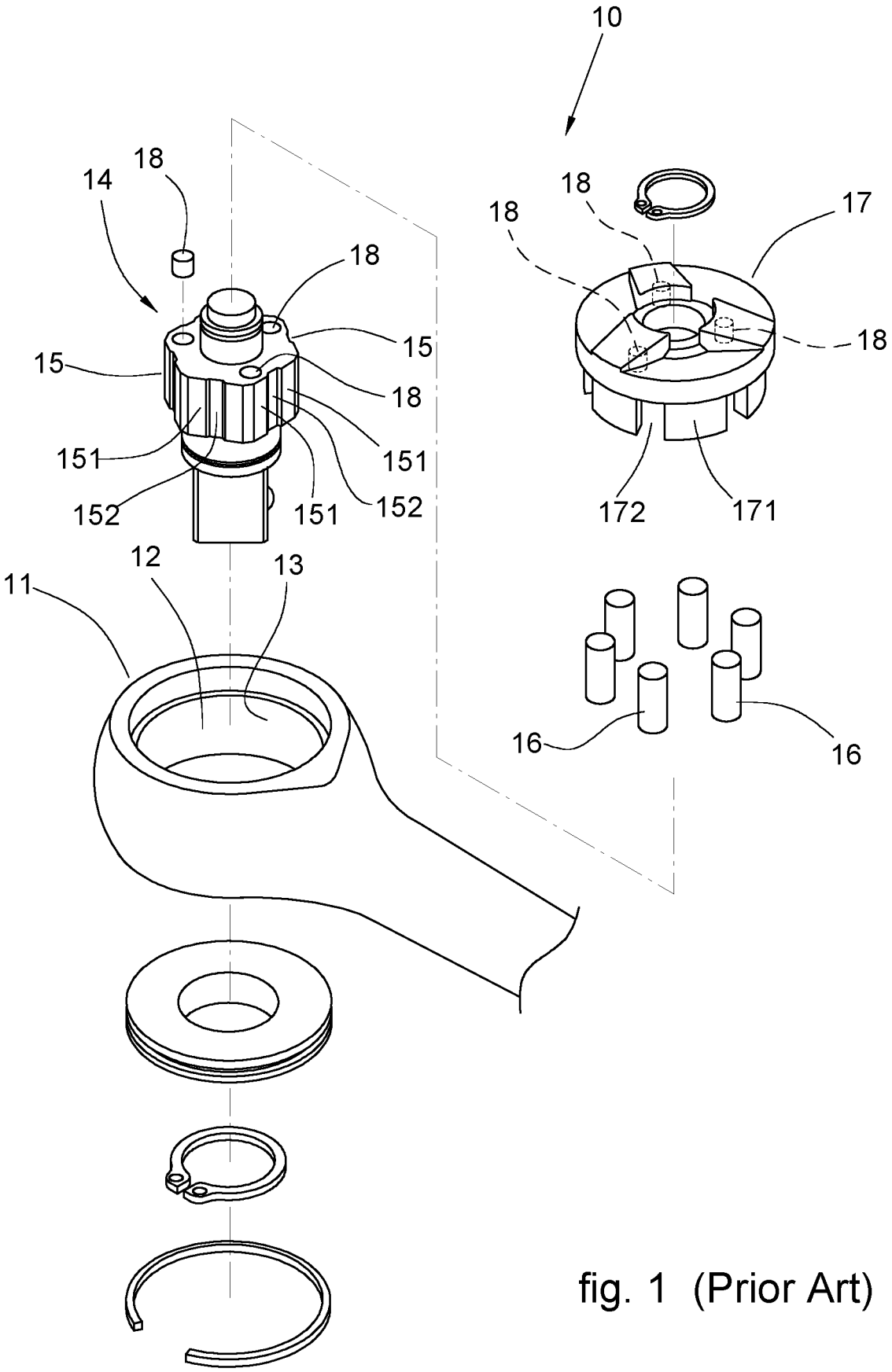
fig. 1 (Prior Art)
FIG. 1 is a partial exploded perspective view of a conventional roller wrench.
Figure 2:
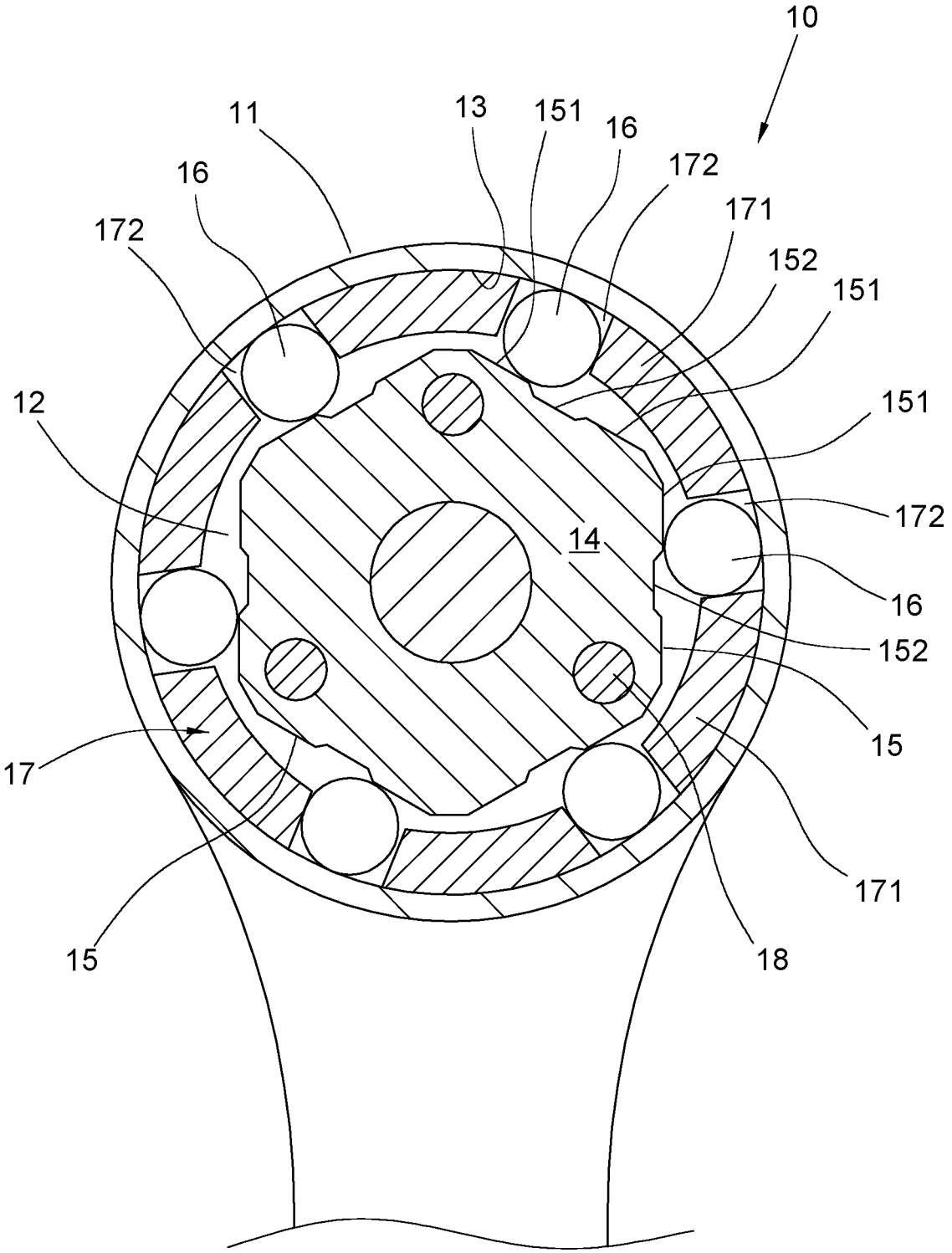
fig. 2 (Prior Art)
FIG. 2 is a partial assembled sectional view of the conventional roller wrench in FIG. 1.
Figure 3:
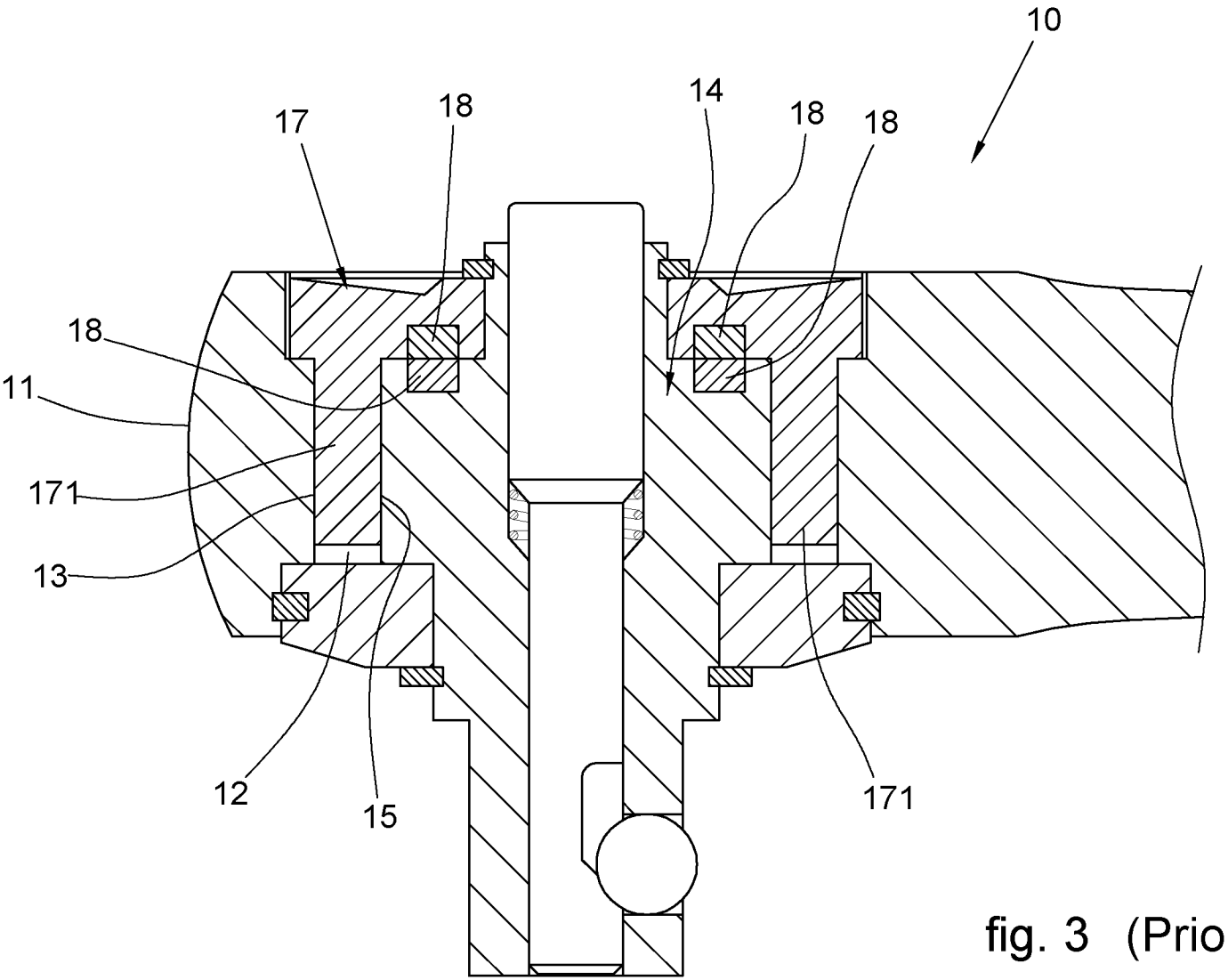
fig. 3 (Prior Art)
FIG. 3 is a partial longitudinal sectional view of the conventional roller wrench in FIG. 2.
Figure 4:
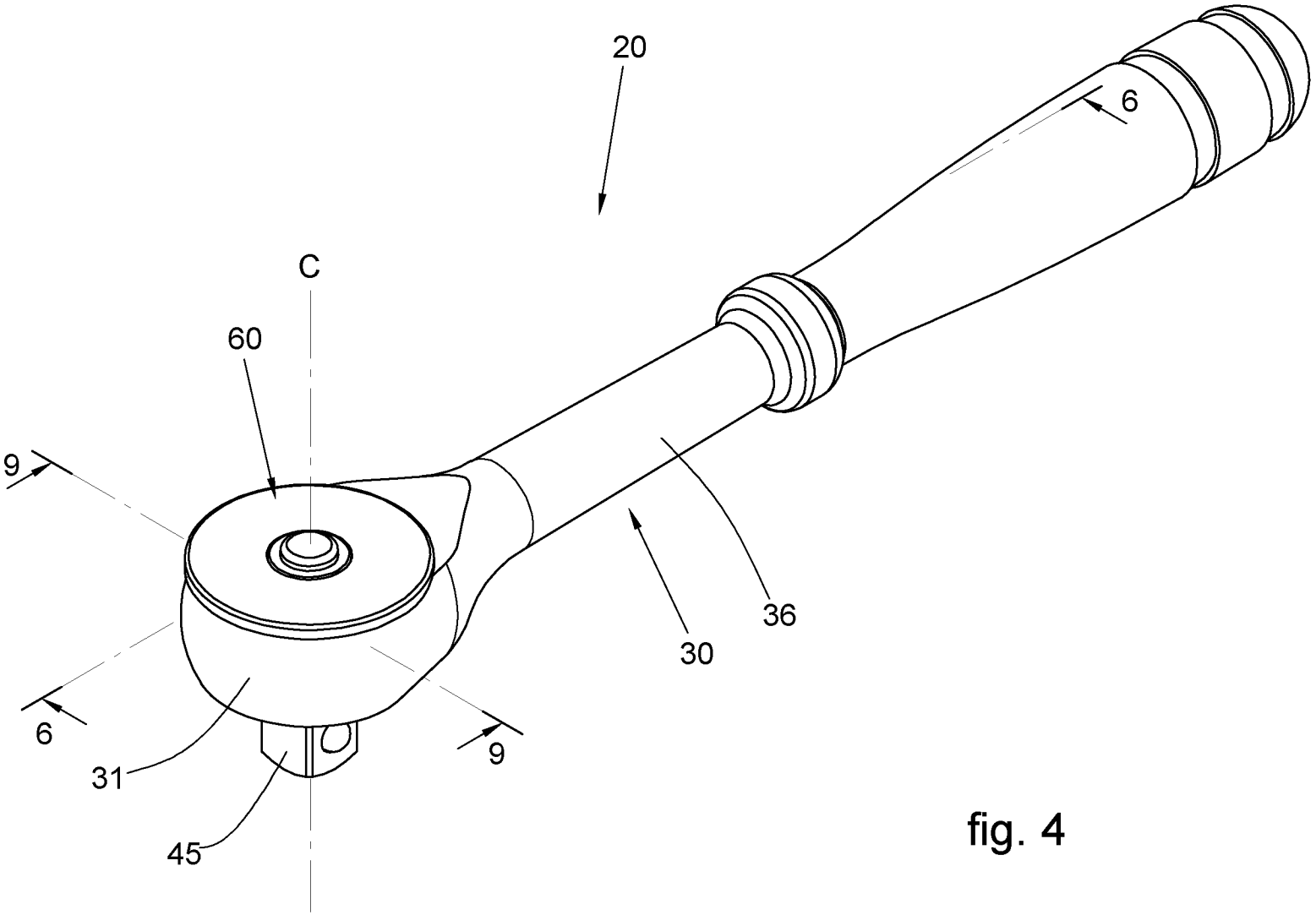
FIG. 4 is a perspective view of the roller wrench according to a preferred embodiment of the invention.
Figure 5:
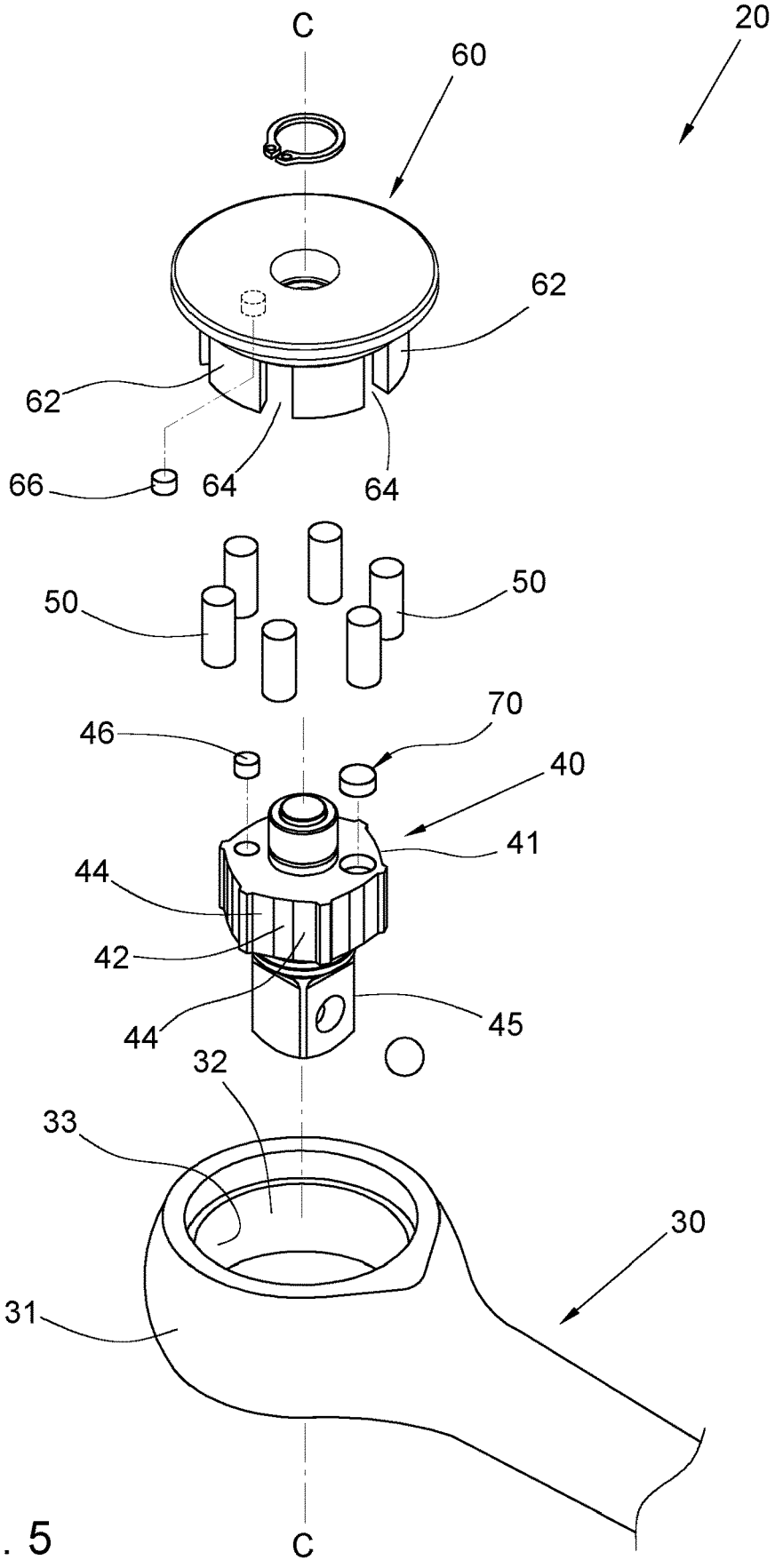
FIG. 5 is a partial exploded perspective view of the roller wrench in FIG. 4.
Figure 6:
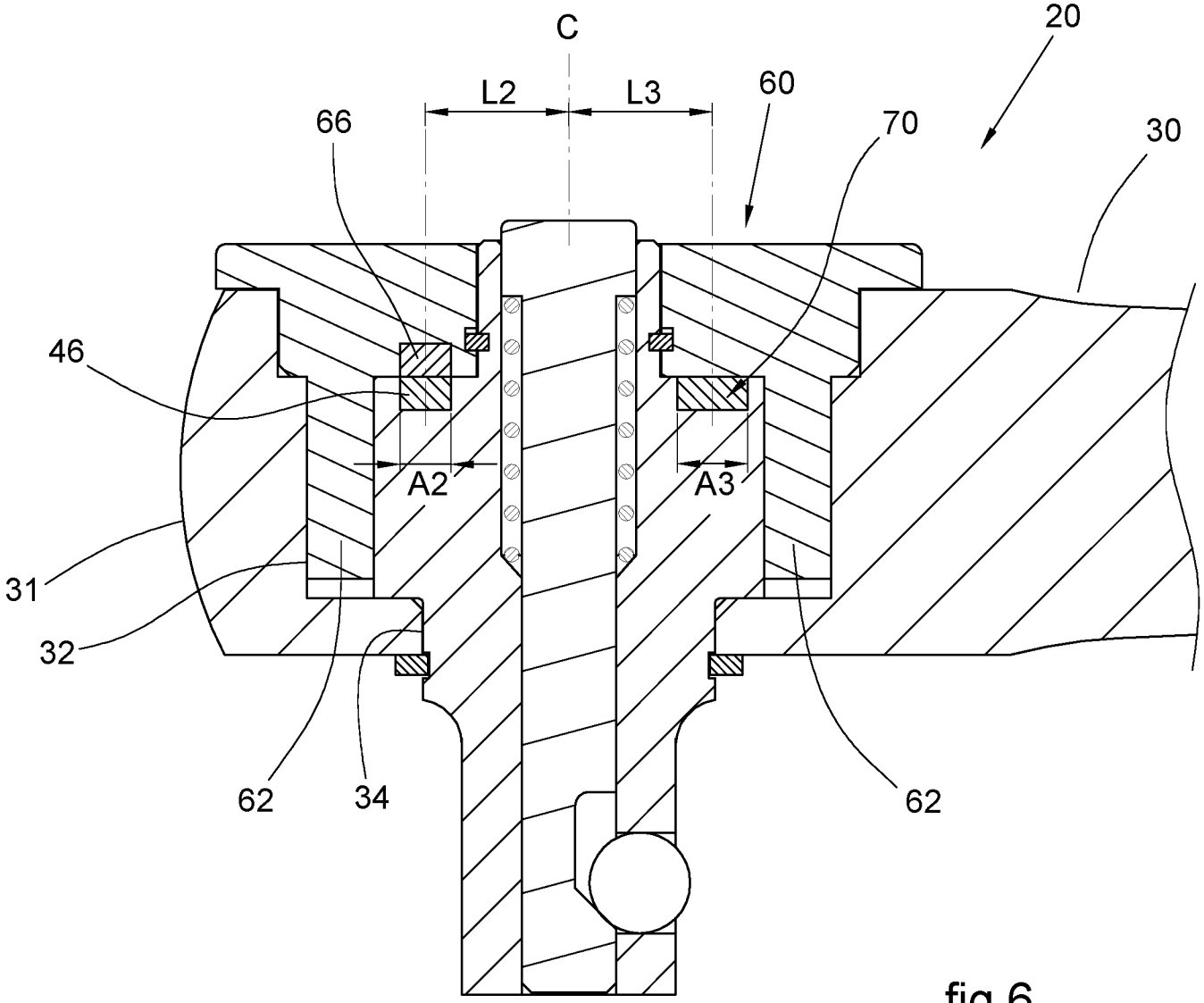
FIG. 6 is a partial sectional view taken along line 6-6 in FIG. 4.

Referring to FIG. 4 to FIG. 6, the roller wrench 20 according to a preferred embodiment of the present invention includes a main body 30, a driving member 40, a plurality of rollers 50, a direction changing knob 60, a magnetic balancing member 70, and a magnetic positioning unit, wherein the magnetic positioning unit includes a first magnetic member 46 and a second magnetic member 66.

The main body 30 has a head portion 31 and a shaft 36 connected to the head portion 31. The head portion is located at the front end of the shaft. The top side of the head portion 31 is concavely provided with a circular receiving chamber 32, and the bottom side of the head portion 31 is hollow, e.g., is provided with a through hole 34. The center of the receiving chamber 32 defines an axis C.

Figure 7:
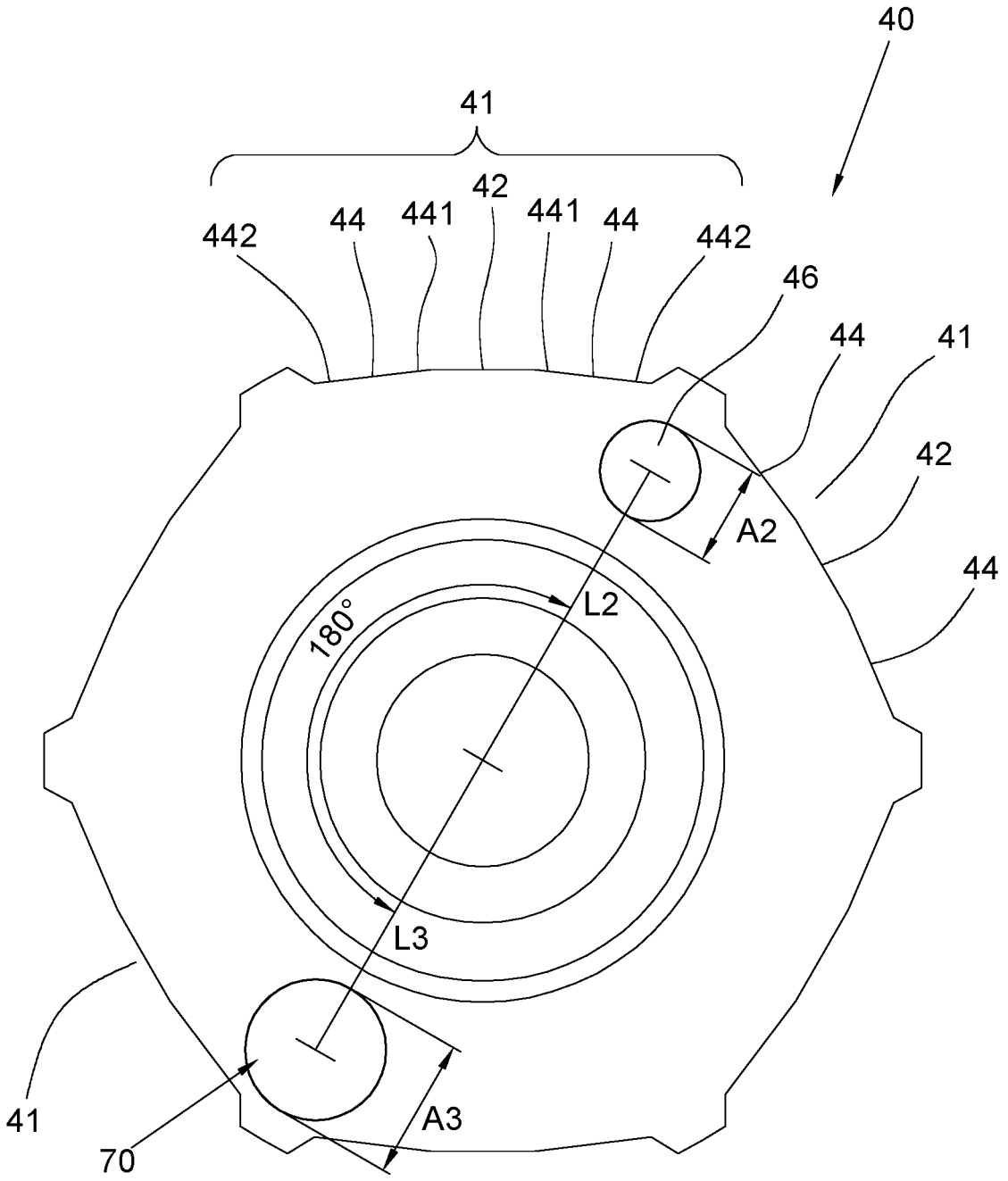
FIG. 7 is a top view of the driving member.

As shown in FIG. 7, the driving member 40 is a component of a regular polygonal shape such as a square, a regular pentagon, a regular hexagon, or a regular octagon and has a plurality of sides. In the preferred embodiments disclosed herein, the driving member 40 is of a regular hexagonal shape by way of example and has six sides 41. Each side 41 of the driving member 40 has a central region 42 formed as a flat surface. Each side 41 is also provided with an engaging surface 44 on each of two lateral sides of the corresponding central region 42. Each engaging surface 44 has an inner side 441 connected to the corresponding central region 42 and an outer side 442 located away from the corresponding central region 42. The driving member 40 is mounted in the receiving chamber 32 of the head portion 31 as shown in FIG. 5 and FIG. 6 and can be rotated in the receiving chamber 32 about a rotation axis defined by the axis C. The driving member 40 is configured to couple with and drive a threaded connecting element such as a nut or bolt into rotation, or couple with a socket. The center of the driving member 40 may be provided with a polygonal mounting hole for connecting with a threaded connecting element. In this embodiment, the bottom side of the driving member 40 has an insertion post 45 extending out of the head portion 31 through the through hole 34. The center of the driving member 40 coincides with the axis C of the main body so that the insertion post 45 can be rotated about a rotation axis defined by the axis C. The top side of the driving member 40 is defined as a first side, and the first magnetic member 46 of the magnetic positioning unit is located on the top side of the driving member 40, i.e., on the first side. The surface of the first magnetic member 46 may have the polarity of an N pole or S pole without limitation. The first magnetic member 46 has a magnetic attraction area A1 and is spaced apart from the axis C by a radial distance L1.

The number of the rollers 50 is equal to the number of the sides 41 of the driving member 40, so there are six rollers 50 mounted in the circular receiving chamber 32. The rollers 50 are located respectively between the six sides 41 and a peripheral wall 33 of the receiving chamber 32.

Figure 8:
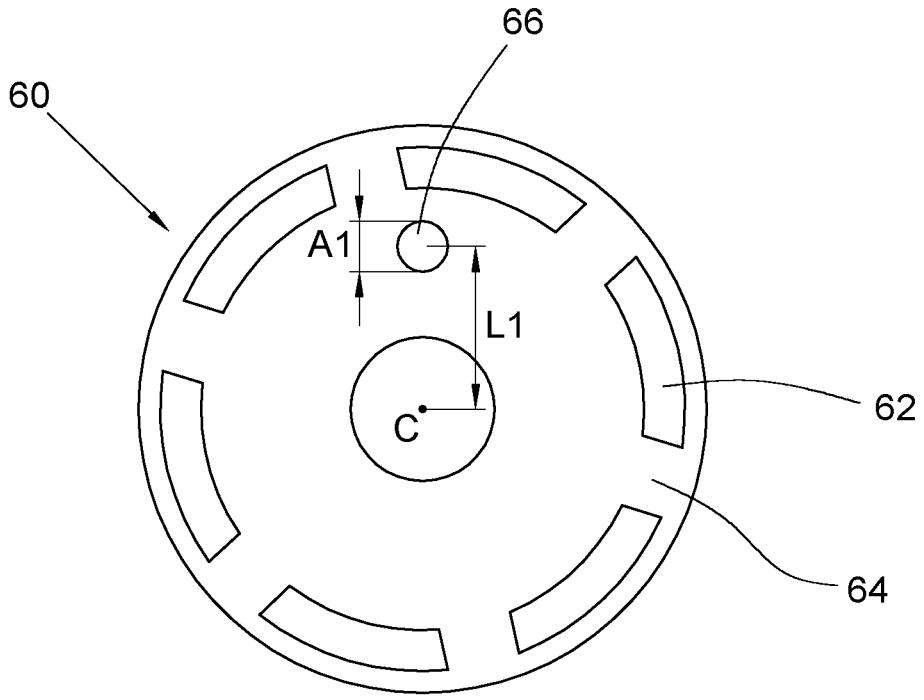
FIG. 8 is a bottom view of the direction changing knob.

The direction changing knob 60 is mounted at the top side of the head portion 31 and closes the opening at the top side of the receiving chamber 32. The direction changing knob 60 is in the form of a circular disk, and the center of the direction changing knob 60 coincides with the axis C of the main body 30 so that the direction changing knob 60 can be rotated about a rotation axis defined by the axis C. The bottom side of the direction changing knob 60 is peripherally provided with a plurality of walls that are arranged at equal intervals and whose number is equal to the number of the rollers 50, i.e., a total of six walls 62 are provided. In addition, there are six position-limiting grooves 64 each formed between two adjacent walls 62. The six walls 62 are arranged at equal intervals in a circular shape as shown in FIG. 8, and the six rollers 50 are received, and thus confined, in the six position-limiting grooves 64 respectively. The bottom side of the direction changing knob 60 is defined as a second side. The first side of the driving member 40 and the second side of the direction changing knob 60 face each other. The second magnetic member 66 of the magnetic positioning unit is located on the bottom side of the direction changing knob 60, i.e., on the second side. The surface of the second magnetic member 66 has the same polarity as the first magnetic member 46, i.e., the first and the second magnetic members may both be N poles or S poles. The second magnetic member 66 has a magnetic attraction area A2 and is spaced apart from the axis C by a radial distance L2. The magnetic attraction area A1 of the first magnetic member 46 and the magnetic attraction area A2 of the second magnetic member 66 are equal, and so are the radial distance L1 between the first magnetic member 46 and the axis C and the radial distance L2 between the second magnetic member 66 and the axis C. The direction changing knob 60 can be rotated between a first position and a second position. When the direction changing knob 60 is rotated to a position between the first position and the second position, the first magnetic member 46 and the second magnetic member 66 are so close to each other that a magnetic repulsive force is produced between the first magnetic member 46 and the second magnetic member 66 due to the closeness of two identical magnetic poles, and the direction changing knob 60 is pushed toward the first position or the second position as a result.

The magnetic balancing member 70 in this embodiment is provided on the top side of the driving member 40, i.e., on the first side, although it is also feasible to provide the magnetic balancing member 70 on the bottom side of the direction changing knob 60. The magnetic balancing member 70 and the second magnetic member 66 are located on two opposite sides of the axis C respectively; in other words, the magnetic balancing member 70 and the second magnetic member 66, which is in the same plane as the magnetic balancing member 70, form a central angle between 150° and 210° with respect to the axis C. In this embodiment, the aforesaid central angle is 180°. The polarity of the magnetic balancing member 70 may be N or S without limitation. The magnetic balancing member 70 serves mainly to attract the direction changing knob 60 magnetically. The magnetic balancing member 70 has a magnetic attraction area A3 and is spaced apart from the axis C by a radial distance L3. In this embodiment, the magnetic attraction area A3 of the magnetic balancing member 70 is larger than the magnetic attraction area A1 of the first magnetic member 46 and the magnetic attraction area A2 of the second magnetic member 66 in order for the magnetic balancing member 70 to have a greater magnetic force than the first magnetic member 46 and the second magnetic member 66 of the magnetic positioning unit. Alternatively, the magnetic balancing member 70 may be composed of a magnetic member having a greater unit magnetic force than the first magnetic member 46 and the second magnetic member 66 so that given the same magnetic attraction area, the magnetic balancing member 70 can produce a greater magnetic attractive force than the first magnetic member 46 and the second magnetic member 66. In this embodiment, the radial distance L3 between the magnetic balancing member 70 and the axis C is equivalent to the radial distance L1 between the first magnetic member 46 and the axis C and the radial distance L2 between the second magnetic member 66 and the axis C.

The following paragraphs describe certain states of use of the roller wrench 20. The direction changing knob 60 can drive the rollers 50 into displacement and be secured at the first position or the second position in order to switch the roller wrench 20 between different operation directions. Take the directions shown in FIG. 4 and FIG. 6 for example. Rotating the direction changing knob 60 counterclockwise can switch the direction changing knob 60 to the first position and thereby displace the rollers 50 to the first position shown in FIG. 8, where each roller 50 is in contact with the left engaging surface 44*a* of the corresponding side 41. Rotating the direction changing knob 60 clockwise can switch the direction changing knob 60 to the second position and thereby displace the rollers 50 to the second position shown in FIG. 9(A), where each roller 50 is in contact with the right engaging surface 44*b* of the corresponding side 41. To facilitate identification of the first position and the second position, the left engaging surfaces are indicated by the reference numeral 44*a*, and the right engaging surfaces by the reference numeral 44*b*. When referred to collectively, the engaging surfaces are indicated by the reference numeral 44.

Figure 10:
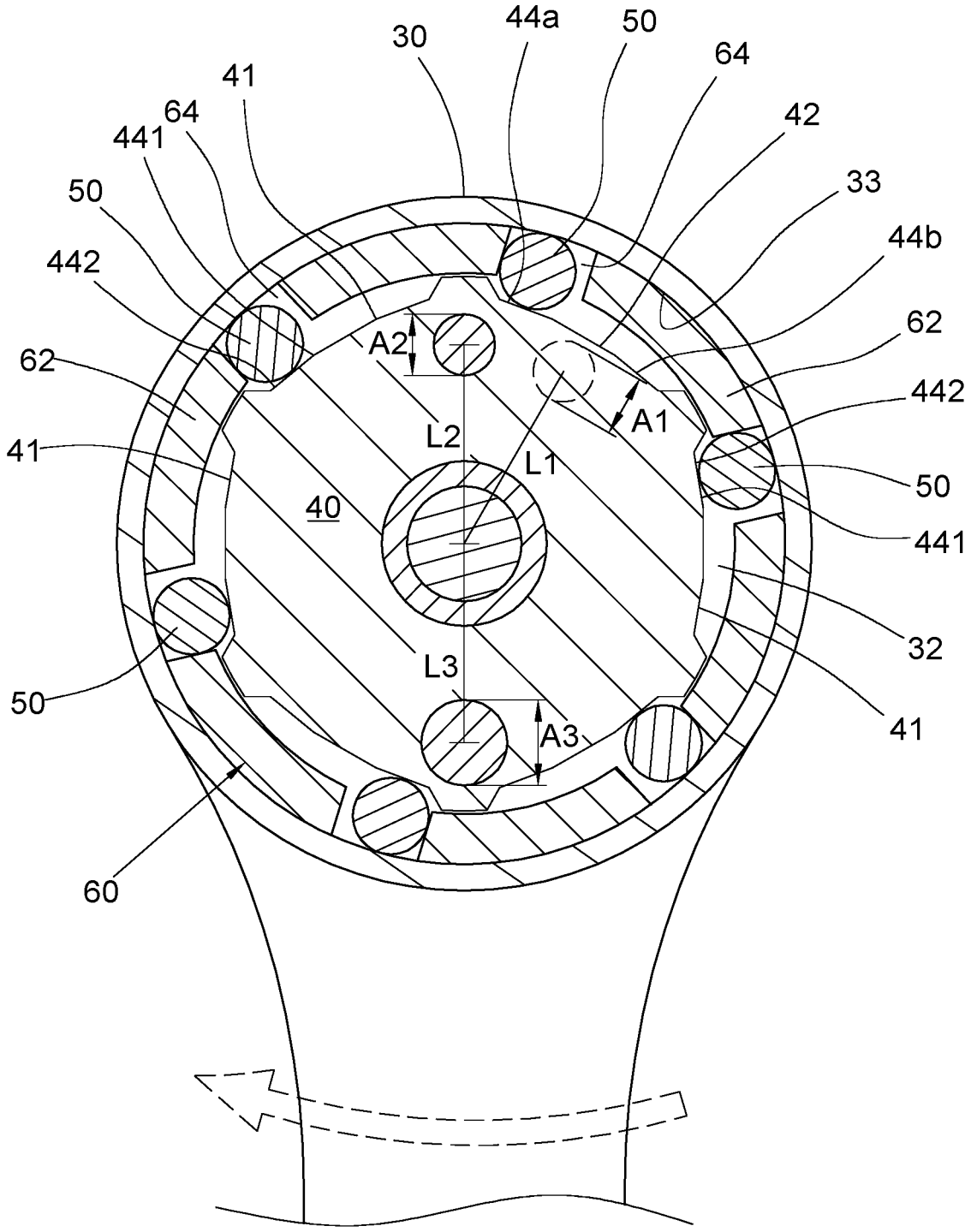
FIG. 10 is a partial assembled sectional view of the roller wrench in FIG. 4, showing the roller wrench rotated clockwise while the direction changing knob is at the first position.

In FIG. 10, the direction changing knob 60 and the rollers 50 have been switched to the first position, where each roller 50 is in contact with the left engaging surface 44*a* of the corresponding side 41. The second magnetic member 66 in this state is located on the left of the first magnetic member 46 to secure the direction changing knob 60 at the first position, with the rollers 50 limited to the first position by the position-limiting grooves 64 of the direction changing knob 60.

The gap between each engaging surface 44*a* and the peripheral wall 33 of the receiving chamber 32 is gradually reduced in an outward direction along the outer side 442 of the engaging surface 44*a* and is gradually increased in an inward direction along the inner side 441 of the engaging surface 44*a*. When the rollers 50 are at the first position, rotating the wrench 20 clockwise will move each roller 50 toward the increasingly narrow end of the gap associated with the corresponding engaging surface 44*a* (i.e., outward along the corresponding outer side 442) such that each roller 50 is engaged with the corresponding engaging surface 44*a* and the peripheral wall 33 of the receiving chamber 32, thereby allowing the wrench 20 to drive the driving member 40, and hence the threaded connecting element coupled thereto, into clockwise rotation. Conversely, rotating the wrench 20 counterclockwise will move each roller 50 toward the increasingly wide end of the corresponding gap and thereby disengage each roller 50 from the corresponding engaging surface 44*a* and the peripheral wall 33 of the receiving chamber 32, making it impossible for the wrench to drive the driving member 40 into rotation. The engaging and disengaging effects described above enable the wrench 20 to rotate a threaded connecting element in only one direction (clockwise in this case).

Figure 9A:
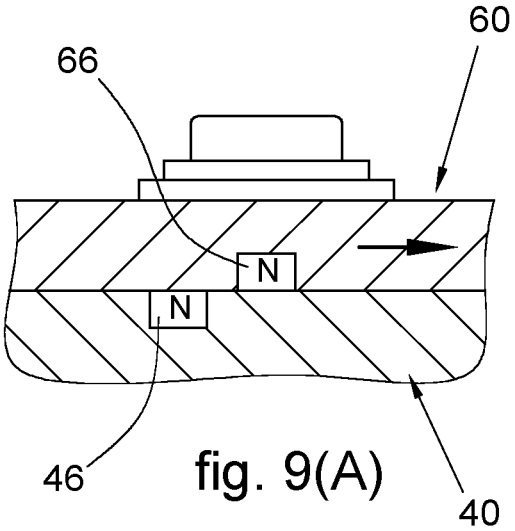
FIG. 9(A) is a sectional view taken along line 9-9 in FIG. 4, showing the direction changing knob moved toward a second position.

When the direction changing knob 60 is rotated clockwise to the second position as shown in FIG. 9(A), the rollers 50 are driven by the direction changing knob 60 to the second position and each end up in contact with the right engaging surface 44*b* of the corresponding side 41. When the direction changing knob 60 is moved to a position between the first position and the second position, the second magnetic member 66 on the direction changing knob 66 is so close to the first magnetic member 46 on the driving member 40 that a magnetic repulsive force is produced between the first magnetic member 46 and the second magnetic member 66 because of the same magnetic polarity of the first and the second magnetic members 46 and 66. Once the second magnetic member 66 on the direction changing knob 60 moves past the first magnetic member 46 after being rotated from the first position, the magnetic repulsive force between the first magnetic member 46 and the second magnetic member 66 pushes the direction changing knob 60 to the second position. Since the first magnetic member 46 and the second magnetic member 66 repel each other, the direction changing knob 60 will not be moved back to the first position. Now, with the first magnetic member 46 magnetically attracted to the bottom side of the direction changing knob 60 and the second magnetic member 66 magnetically attracted to the top side of the driving member 40, the direction changing knob 60 and the driving member 40 are secured in position with respect to each other magnetically. To keep the driving member 40 in balance, the magnetic balancing member 70 produces magnetic attraction on the opposite side and is magnetically attracted to the direction changing knob 60 in order for the two opposite sides of the driving member 40 with respect to the axis C to be subjected to magnetic attraction evenly, which prevents the driving member 40 from tilting. As the magnetic attraction area A3 of the magnetic balancing member 70 is larger than the magnetic attraction area A1 of the first magnetic member 46 and the magnetic attraction area A2 of the second magnetic member 66, the magnetic attractive forces acting respectively on the two opposite sides of the driving member 40 are equivalent.

Figure 11:
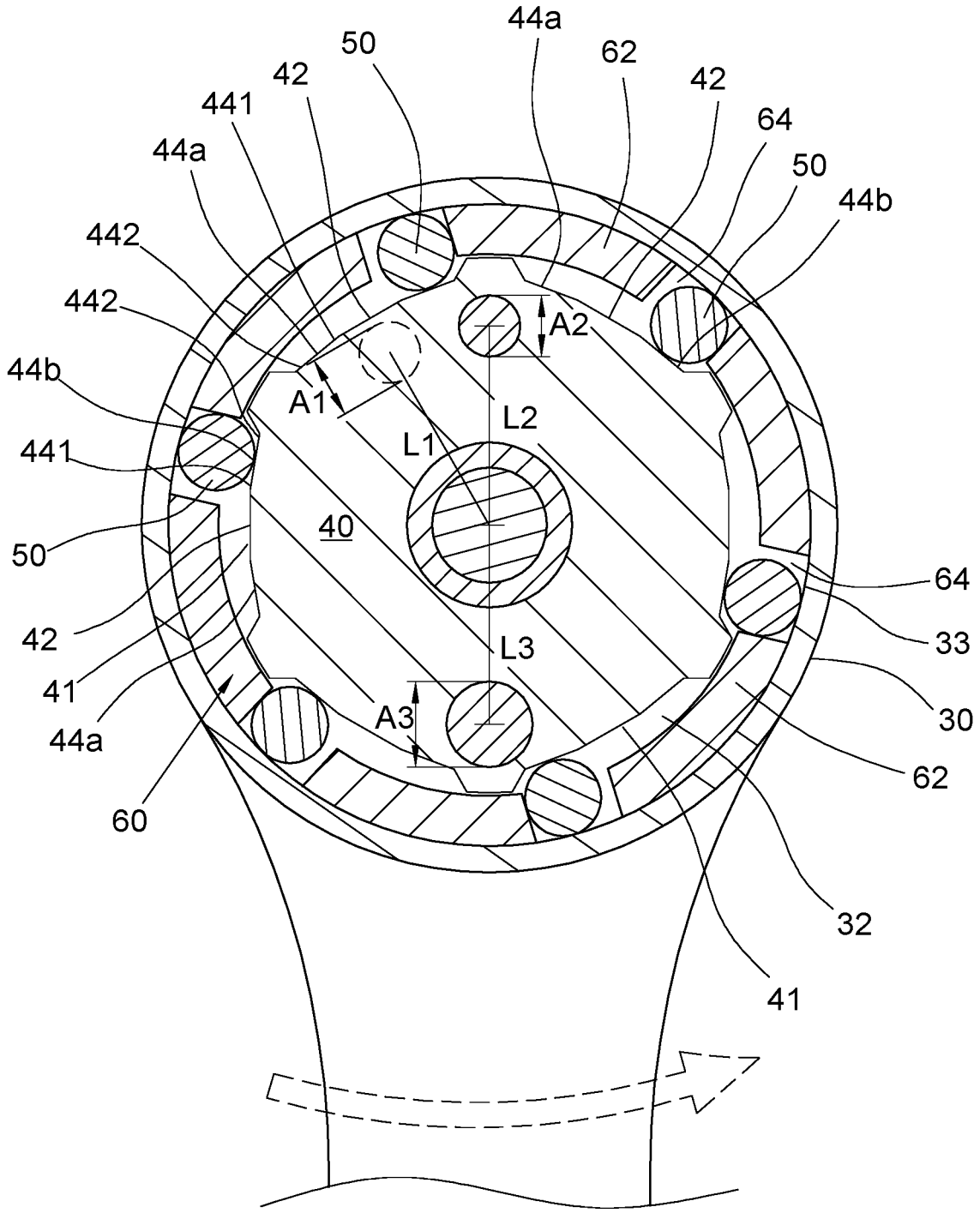
FIG. 11 is generally the same as FIG. 10, showing the roller wrench rotated counterclockwise while the direction changing knob is at the second position.

When the rollers 50 are secured at the second position as shown in FIG. 11, rotating the wrench 20 counterclockwise will move each roller 50 toward the increasingly narrow end of the gap associated with the corresponding engaging surface 44*b* (i.e., outward along the corresponding outer side 442) such that each roller 50 is engaged with the corresponding engaging surface 44*b* and the peripheral wall 33 of the receiving chamber 32, thereby allowing the wrench 20 to drive the driving member 40 into counterclockwise rotation. Conversely, rotating the wrench 20 clockwise will move each roller 50 toward the increasingly wide end of the corresponding gap and thereby disengage each roller 50 from the corresponding engaging surface 44*b* and the peripheral wall 33 of the receiving chamber 32, making it impossible for the wrench to drive the driving member 40 into rotation. The engaging and disengaging effects described above enable the wrench 20 to rotate a threaded connecting element in only one direction (counterclockwise in this case).

Figure 9B:
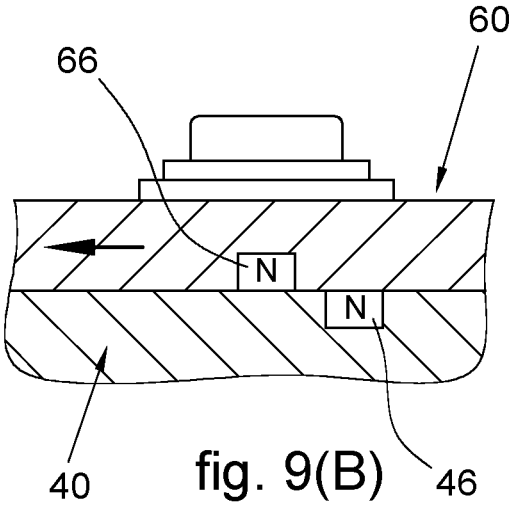
FIG. 9(B) is another sectional view taken along line 9-9 in FIG. 4, showing the direction changing knob moved toward a first position.

Referring to FIG. 9(B), the direction changing knob 60 can be switched from the second position to the first position in a way similar to switching the direction changing knob 60 from the first position to the second position. The second magnetic member 66 on the direction changing knob 60 and the first magnetic member 46 on the driving member 40 are brought close to each other when the direction changing knob 60 is moved to a position between the first position and the second positon. Once the second magnetic member 66 on the direction changing knob 60 moves past the first magnetic member 46 after being rotated from the second position, the magnetic repulsive force between the first magnetic member 46 and the second magnetic member 46 pushes the direction changing knob 60 to the first position. Since the first magnetic member 46 and the second magnetic member 66 repel each other, the direction changing knob 60 will not be moved back to the second position. Now, with the first magnetic member 46 magnetically attracted to the bottom side of the direction changing knob 60 and the second magnetic member 66 magnetically attracted to the top side of the driving member 40, the direction changing knob 60 and the driving member 40 are secured in position with respect to each other magnetically. The magnetic balancing member 70 also produces magnetic attraction on the opposite side and is magnetically attracted to the direction changing knob 60.

Figure 12:
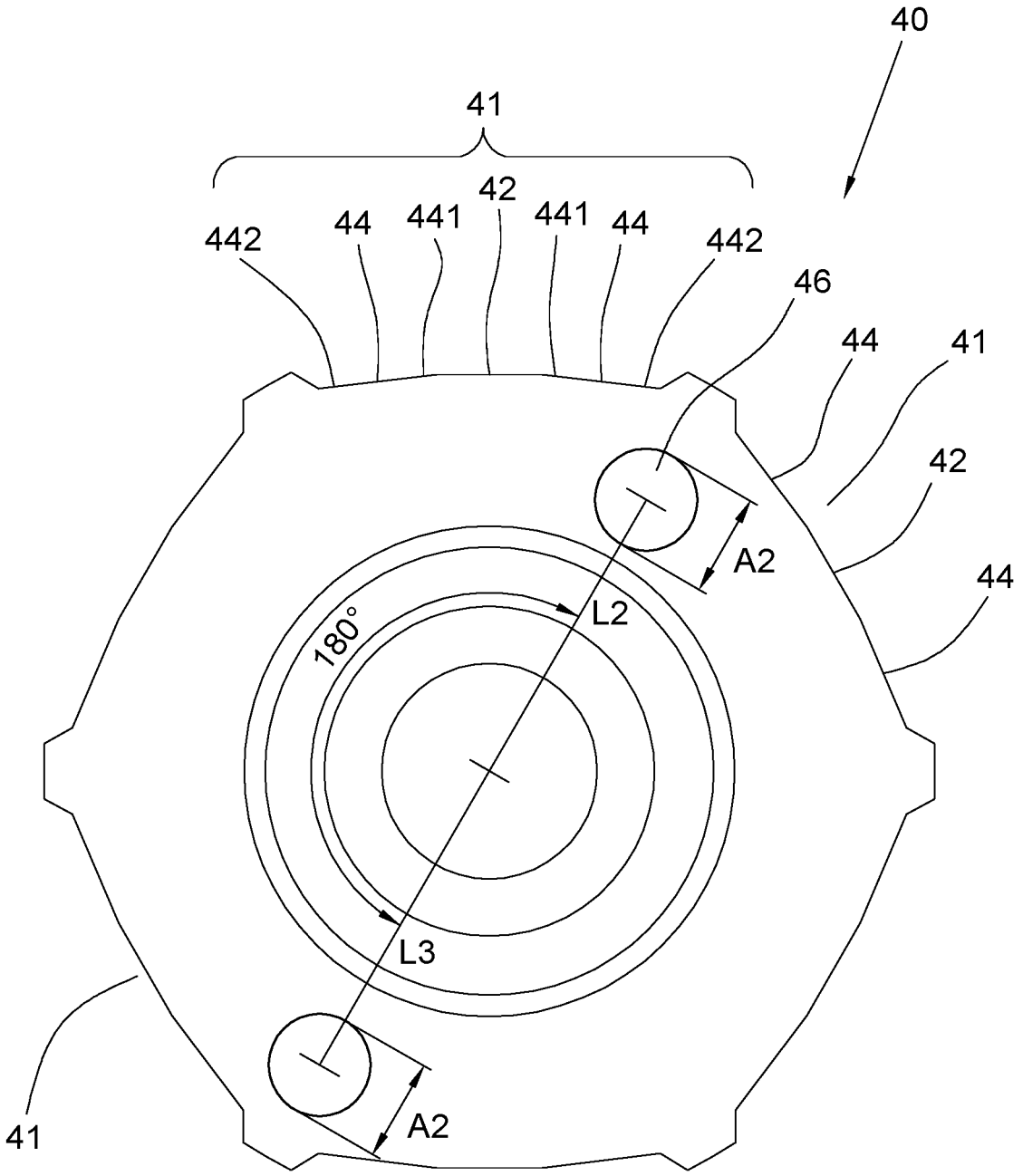
FIG. 12 is a top view of the driving member in the second preferred embodiment of the invention, showing that the radial distance between the magnetic balancing member and the axis is greater than the radial distance between the magnetic positioning unit and the axis.

Please refer to FIG. 12 for the second preferred embodiment of the present invention. The main structure of the second preferred embodiment is the same as that of the previous embodiment, and the identical structural features in the two embodiments are indicated by the same reference numeral and will not be described repeatedly.

The second preferred embodiment is different in that the magnetic attraction area A3 and the unit magnetic force of the magnetic balancing member 70 are respectively equal to the magnetic attraction area A1 and the unit magnetic force of the first magnetic member 46 or the magnetic attraction area A2 and the unit magnetic force of the second magnetic member 66, which makes the three magnetic members interchangeable, and that in order for the magnetic balancing member 70 to produce stronger magnetic attraction than the first and the second magnetic members 46 and 66, the radial distance L3 between the magnetic balancing member 70 and the axis C is greater than the radial distance L1 between the first magnetic member 46 and the axis C and the radial distance L2 between the second magnetic member 66 and the axis C. The greater radial distance L3 forms a longer moment arm when the magnetic balancing member 70 produces magnetic attraction, thereby allowing a balance between the magnetic balancing member 70 and the first and the second magnetic members 46 and 66 to be achieved.

Figure 13:
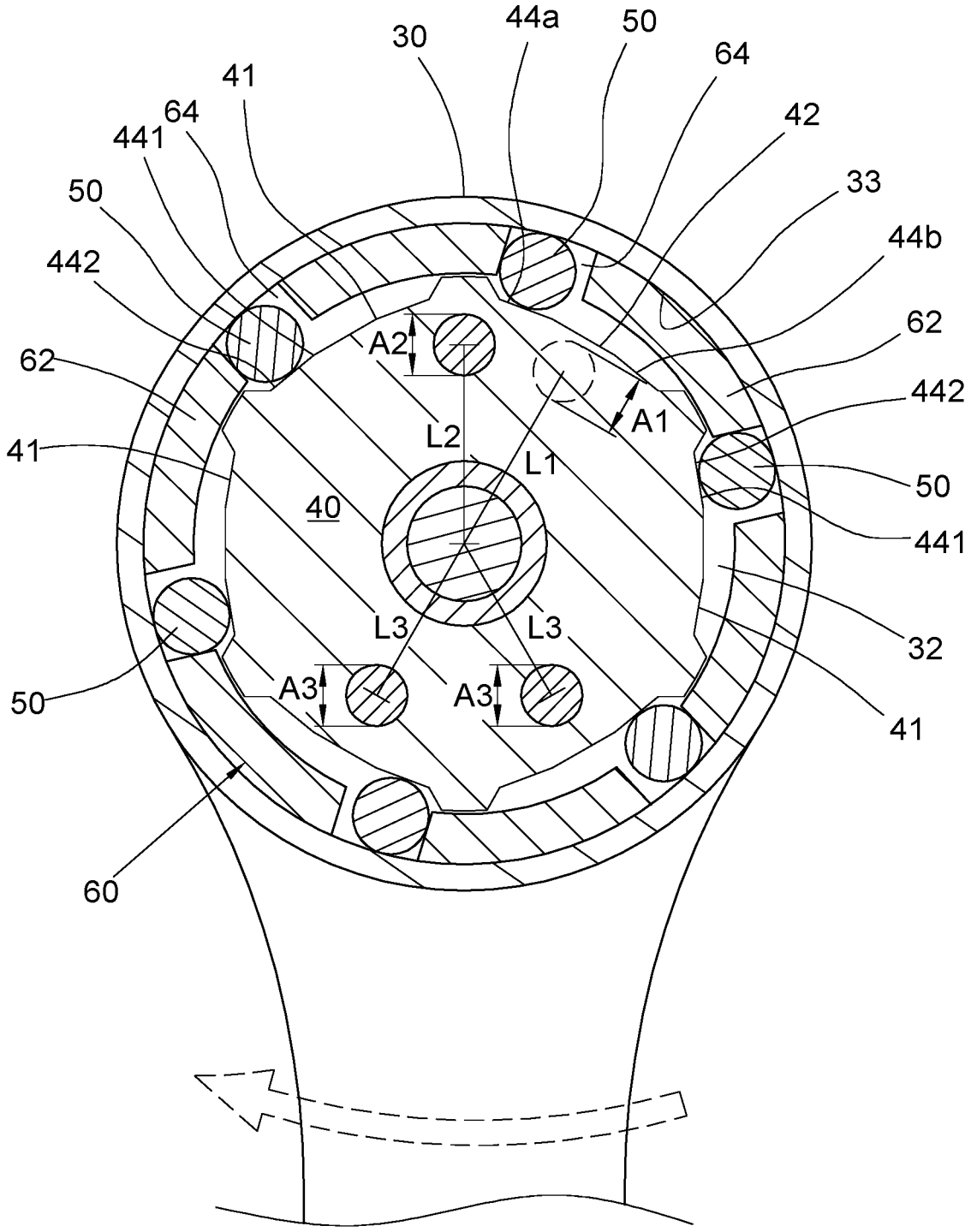
FIG. 13 is a partial assembled sectional view of the roller wrench according to the third preferred embodiment of the invention, showing that there are one magnetic positioning unit and two magnetic balancing members, and that the roller switch is rotated clockwise while the direction changing knob is at the first position.
Figure 14:
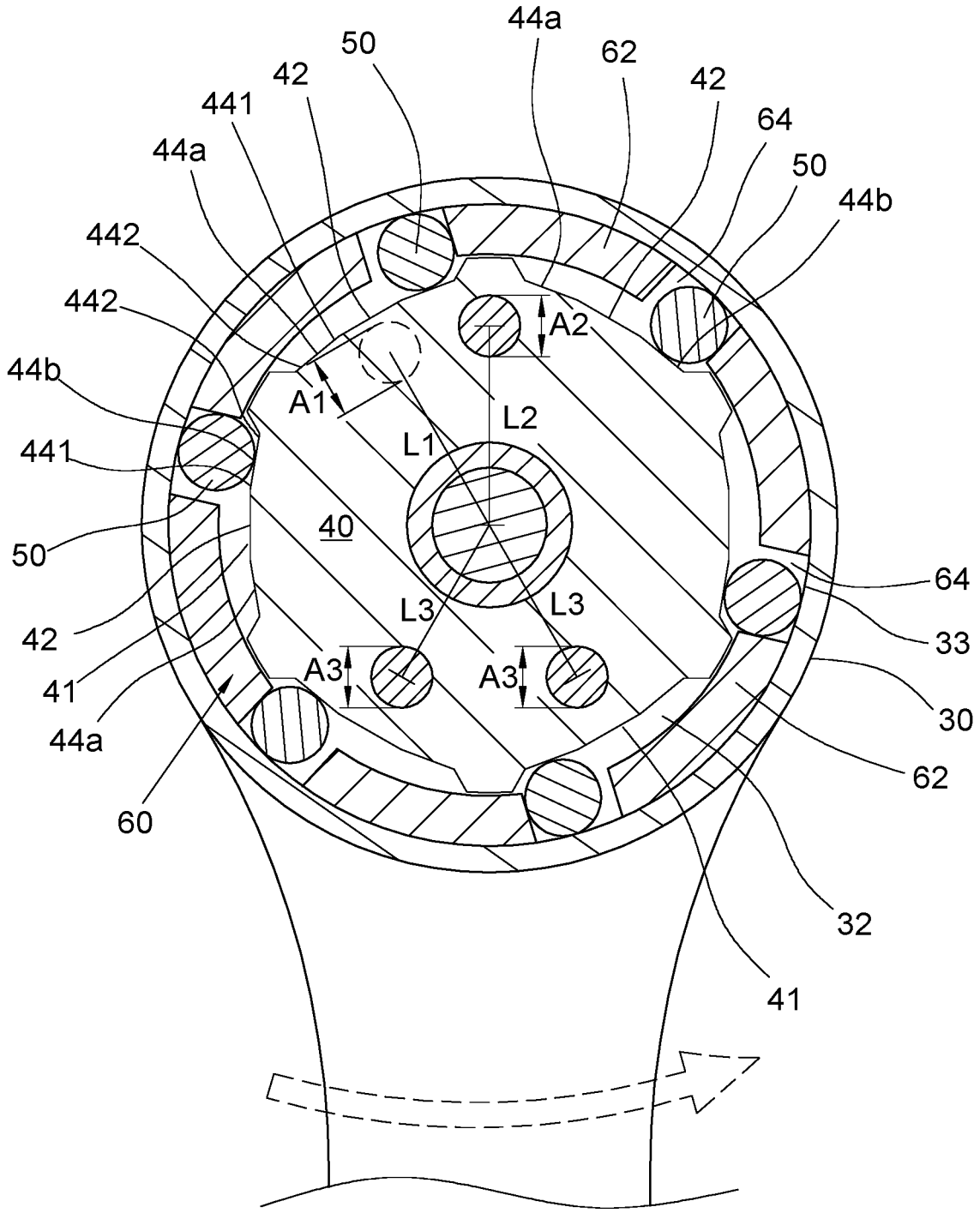
FIG. 14 is generally the same as FIG. 13, showing the roller wrench rotated counterclockwise while the direction changing knob is at the second position.

Please refer to FIG. 13 and FIG. 14 for the third preferred embodiment of the present invention. The main structure of the third preferred embodiment is the same as that of the previous embodiment, and the identical structural features in the two embodiments are indicated by the same reference numeral and will not be described repeatedly.

The third preferred embodiment is different in that the roller wrench 20 is provided with one magnetic positioning unit and two magnetic balancing members 70 between the driving member 40 and the direction changing knob 60, wherein the magnetic positioning unit and the two magnetic balancing members 70 are located on two opposite sides of the axis C respectively. The two magnetic balancing members 70 are provided in the same plane and are both located on the first side, i.e., on the top side of the driving member 40, lest a change in the distance between the two magnetic balancing members 70 result in a magnetic repulsive force therebetween. Also, by disposing the first and the second magnetic members 46 and 66 and the two magnetic balancing members on two opposite sides of the axis C respectively, each of the two opposite sides of the axis C is provided with two magnetic components to enable uniform magnetic attraction.

Figure 15:
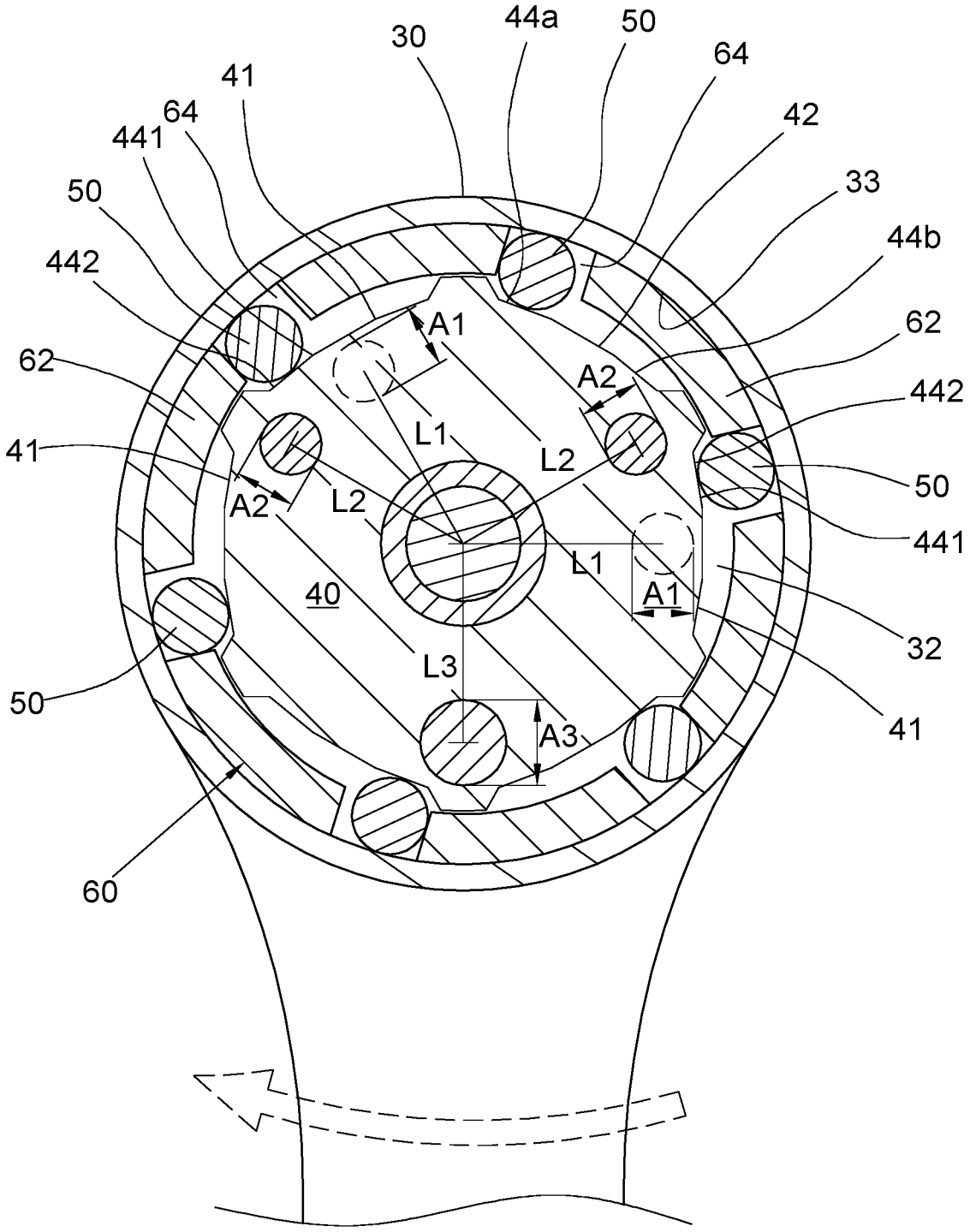
FIG. 15 is a partial assembled sectional view of the roller wrench according to the fourth preferred embodiment of the invention, showing that there are two magnetic positioning units and one magnetic balancing member, and that the roller switch is rotated clockwise while the direction changing knob is at the first position.
Figure 16:
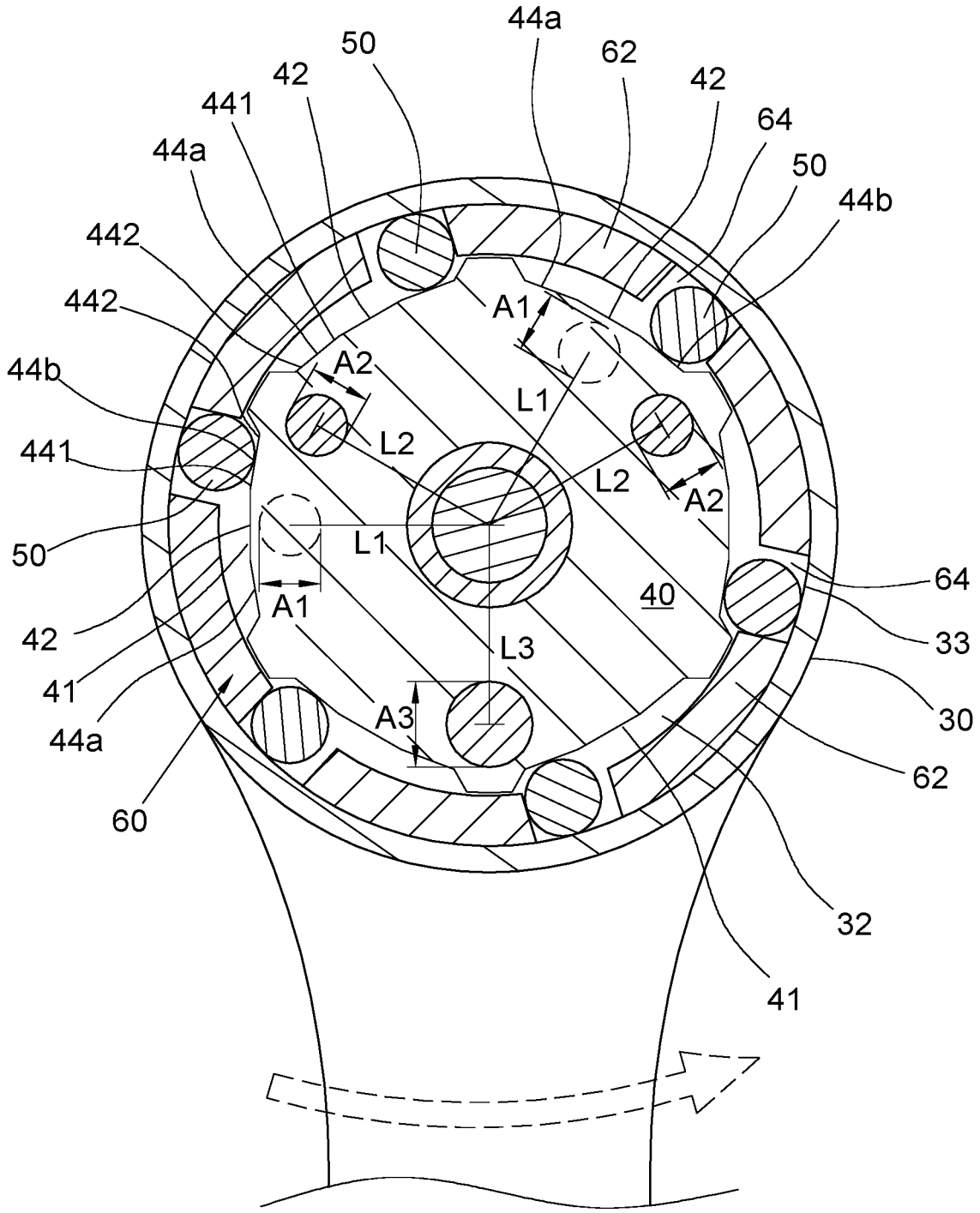
FIG. 16 is generally the same as FIG. 15, showing the roller wrench rotated counterclockwise while the direction changing knob is at the second position.

Please refer to FIG. 15 and FIG. 16 for the fourth preferred embodiment of the present invention. The main structure of the fourth preferred embodiment is the same as that of the previous embodiment, and the identical structural features in the two embodiments are indicated by the same reference numeral and will not be described repeatedly.

The fourth preferred embodiment is different in that the roller wrench 20 is provided with two magnetic positioning units and one magnetic balancing member 70 between the driving member 40 and the direction changing knob 60, wherein the two magnetic positioning units and the magnetic balancing member 70 are located on two opposite sides of the axis C respectively. The magnetic attraction positions of the two first magnetic members 46 and of the two second magnetic members 66 are evenly distributed, with the magnetic balancing member 70 provided on the opposite side to balance the overall application of magnetic attractive forces. Moreover, the magnetic balancing member 70 and the two first magnetic members 46 are provided in the same plane, i.e., both on the first side, and the central angle formed between the magnetic balancing member 70 and one of the two first magnetic members 46 with respect to the axis C is generally equal to that between the magnetic balancing member 70 and the other first magnetic member 46 to enable even distribution of the magnetic attractive forces of the magnetic balancing member 70 and of the two first magnetic members 46 and therefore uniform magnetic attraction.

The roller wrench 20 of the present invention has the following effects that provide an improvement over its prior art counterparts. First, a change of direction can be achieved with at least one magnetic positioning unit (i.e., at least two magnetic members). Compared with the prior art, which requires three magnetic positioning units (i.e., six magnetic members), the magnetic repulsive force that must be overcome is reduced, meaning the direction changing operations will not be hindered by an exceedingly great magnetic repulsive force.

Second, the wrench of the present invention uses fewer magnetic components than the prior art (i.e., at least one magnetic positioning unit and at least one magnetic balancing member) to enable a switch of the operation direction of the wrench and allow the direction changing components to be secured in position after each direction changing operation. Thanks to the reduction of use of magnetic components, the production cost of the wrench disclosed herein is lower than that of the prior art, which uses six magnetic members. Furthermore, the magnetic balancing member does not produce a magnetic repulsive force and therefore does not add to the repulsive force produced by the magnetic positioning unit during a direction changing operation, lest the direction changing operation be hindered by too great a repulsive force.

The embodiments described above serve only to expound the technical features, but not to limit the scope, of the present invention. All simple modifications and equivalent implementations based on the disclosure of this specification and the appended claims shall fall within the scope of the patent protection sought by the applicant.

What is claimed is:

1. A magnetically assisted direction-changeable roller wrench, comprising:

a main body having a head portion and a shaft connected to the head portion, wherein the head portion is provided therein with a circular receiving chamber, and the receiving chamber has a peripheral wall and has a center defining an axis;

a driving member of a regular polygonal configuration, wherein the driving member has a plurality of sides, each said side has a central region and two engaging surfaces located respectively on two lateral sides of the central region, each said engaging surface has an inner side adjacent to a corresponding said central region and an outer side located away from the corresponding central region, and the driving member is mounted in the receiving chamber of the head portion and is rotatable in the receiving chamber about a rotation axis defined by the axis;

a direction changing knob mounted in the head portion, wherein the direction changing knob is rotatable between a first position and a second position;

a plurality of rollers corresponding in number to the sides of the driving member, wherein the rollers are located between the peripheral wall of the receiving chamber of the main body and the driving member, the driving member is configured to drive the rollers into displacement, each said roller is in contact with a said engaging surface on a lateral side of a corresponding said side of the driving member and the peripheral wall of the receiving chamber when the direction changing knob is at the first position, and each said roller is in contact with a said engaging surface on an opposite lateral side of the corresponding side of the driving member and the peripheral wall of the receiving chamber when the direction changing knob is at the second position;

at least one magnetic positioning unit, wherein each said magnetic positioning unit comprises a first magnetic member and a second magnetic member, the first magnetic member of each said magnetic positioning unit is located on the driving member, the second magnetic member of each said magnetic positioning unit is located on the direction changing knob, the first magnetic member and the second magnetic member of each said magnetic positioning unit have corresponding surfaces of a same magnetic polarity, and the first magnetic member and the second magnetic member of each said magnetic positioning unit are able to generate a magnetic repulsive force therebetween such that the direction changing knob is secured at the first position or the second position by the magnetic repulsive force after being switched in position; and at least one magnetic balancing member located on the driving member or the direction changing knob, wherein the at least one magnetic balancing member and the at least one magnetic positioning unit are provided on two opposite sides of the axis respectively, and the at least one magnetic balancing member exerts a greater magnetic torque against the direction changing knob than that exerted by the at least one magnetic positioning unit.

2. The roller wrench of claim 1, wherein the roller wrench has one said magnetic positioning unit and one said magnetic balancing member, and the magnetic balancing member and the first or the second magnetic member in a same plane as the magnetic balancing member form a central angle of 150° to 210° with respect to the axis.

3. The roller wrench of claim 1, wherein the roller wrench has two said magnetic positioning units and one said magnetic balancing member, and the magnetic balancing member and the two first or second magnetic members in a same plane as the magnetic balancing member form generally equal central angles with respect to the axis.

4. The roller wrench of claim 1, wherein the roller wrench has one said magnetic positioning unit and two said magnetic balancing members, and the two magnetic balancing members are located concurrently on the driving member or the direction changing knob.

5. The roller wrench of any of claims 1 to 4, wherein the at least one magnetic balancing member is provided on the driving member.

6. The roller wrench of any of claims 1 to 4, wherein the at least one magnetic balancing member is provided on the direction changing knob.

7. The roller wrench of any of claims 1 to 4, wherein the at least one magnetic balancing member has a greater magnetic force than the first magnetic member or the second magnetic member of the at least one magnetic positioning unit.

8. The roller wrench of claim 7, wherein each said magnetic balancing member has a larger magnetic attraction area than each said first magnetic member or each said second magnetic member.

9. The roller wrench of claim 7, wherein each said magnetic balancing member has a greater unit magnetic force than each said first magnetic member or each said second magnetic member.

10. The roller wrench of any of claims 1 to 4, wherein a radial distance between each said magnetic balancing member and the axis is greater than a radial distance between each said first magnetic member or each said second magnetic member and the axis.

11. The roller wrench of any of claims 1 to 4, wherein the driving member has a side facing the direction changing knob and defined as a first side, each said first magnetic member is provided on the first side, the direction changing knob has a side facing the driving member and defined as a second side, each said second magnetic member is provided on the second side, the first side faces the second side, and each said magnetic balancing member is located concurrently on the first side or the second side.

* * * * *